US005670999A

United States Patent [19]

Takeuchi et al.

[11] Patent Number: 5,670,999

[45] Date of Patent: Sep. 23, 1997

[54] INK JET PRINT HEAD HAVING MEMBERS WITH DIFFERENT COEFFICIENTS OF THERMAL EXPANSION

[75] Inventors: Yukihisa Takeuchi, Aichi-ken; Nobuo Takahashi, Owariasahi; Shigeki Okada, Nagoya, all of Japan

[73] Assignees: NGK, Insulators, Ltd.; Seiko Epson Corporation, both of Japan

[21] Appl. No.: 600,651

[22] Filed: Feb. 13, 1996

Related U.S. Application Data

[63] Continuation of Ser. No. 110,801, Aug. 23, 1993, abandoned.

[30] Foreign Application Priority Data

Aug. 25, 1992 [JP] Japan ..... 4-248773
Aug. 5, 1993 [JP] Japan ..... 5-194730

[51] Int. Cl.[6] ..... B41J 2/045

[52] U.S. Cl. ..... 347/70; 347/71

[58] Field of Search ..... 347/68, 71, 94, 347/44, 47, 70; 310/328, 330, 346

[56] References Cited

U.S. PATENT DOCUMENTS

| | | | |
|---|---|---|---|
| 3,441,754 | 4/1969 | Heny | 310/346 |
| 3,747,120 | 7/1973 | Stemme | 346/75 |
| 3,946,398 | 3/1976 | Kyser et al. | 346/1 |
| 4,680,595 | 7/1987 | Cruz-Uribe et al. | 346/140 R |
| 5,113,204 | 5/1992 | Miyazawa et al. | 347/47 |
| 5,126,618 | 6/1992 | Takahashi et al. | 310/346 |

FOREIGN PATENT DOCUMENTS

| | | | |
|---|---|---|---|
| 0427291 | 5/1991 | European Pat. Off. | B41J 2/14 |
| 0521517 | 1/1993 | European Pat. Off. | B41J 2/16 |
| 62-13359 | 1/1987 | Japan | 347/47 |
| 62-213399 | 9/1987 | Japan . | |
| 3-128681 | 5/1991 | Japan . | |
| WO92/09436 | 6/1992 | WIPO | B41J 2/045 |

OTHER PUBLICATIONS

Patent Abstracts of Japan, vol. 15, No. 101 (M-1091) Mar. 11, 1991 & JP-A-03 000255 (Seiko Epson Corp.) Jan. 7, 1991.

Patent Abstracts of Japan, vol. 15, No. 447 (M-1179) Nov. 14, 1991 & JP-A-03 190742 (Seiko Epson Corp.).

Thin Solid Films, vol. 201, No. 2,, Jun. 30, 1991 Lausanne, CH, pp. 253-265, XP 000231086, Jou et al. "An Analysis of Thermal Stresses in a Multilayer Thin Film Printhead".

*Primary Examiner*—Safet Metjahic
*Assistant Examiner*—Michael Dalakis
*Attorney, Agent, or Firm*—Parkhurst, Wendel & Burr, L.L.P.

[57] ABSTRACT

An ink jet print head is disclosed which includes a metallic nozzle member having a plurality of nozzles through which fine particles of ink are jetted, and a ceramic ink pump member superposed on and bonded to the nozzle member. The ink pump member has a plurality of ink chambers formed behind the respective nozzles, and a plurality of piezoelectric/electrostrictive elements each disposed on a portion of the ink pump member opposite a respective ink chamber, for deforming the portion so as to change a pressure of the respective ink chamber, whereby the ink supplied to the ink chamber is jetted through the corresponding nozzle. The ink jet print head further includes a CTE (coefficient of thermal expansion) adjusting member superposed on and bonded to the nozzle member and/or the ink pump member, for reducing a stress which is applied to the ink pump member due to a difference between a coefficient of thermal expansion of the nozzle member and that of the ink pump member.

16 Claims, 8 Drawing Sheets

INK JET PRINT HEAD HAVING MEMBERS WITH DIFFERENT COEFFICIENTS OF THERMAL EXPANSION

This is a Continuation of application Ser. No. 08/110,801 filed Aug. 23, 1993, now abandoned.

BACKGROUND OF THE INVENTION

1. Field of the Invention

The present invention relates in general to an ink jet print head, and more particularly to such an ink jet print head that includes a nozzle member made of metal and an ink pump member (piezoelectric/electrostrictive film type actuator) made of a ceramic material, which are superposed on each other and bonded together into an integral laminar structure. The present invention is concerned with a technique for improving ink-jetting characteristics or capability of the laminar ink jet print head.

2. Discussion of the Related Art

In the recent market of printers, there is a rapidly increasing demand for an ink jet printer which operates quietly at a relatively low cost. The ink jet printer has an ink jet print head which is adapted to raise the pressure in an ink chamber filled with a mass of ink, to thereby jet or discharge fine ink particles from nozzles so as to effect a desired printing operation.

A known type of the ink jet print head uses a piezoelectric/electrostrictive element disposed on a wall of the ink chamber, as means for raising the pressure in the ink chamber. In this type of the print head, a volume of the ink chamber is changed upon energization and displacement of the piezoelectric/electrostrictive element. The ink jet print head of this type is advantageous for reduced consumption of electric power, as compared with another type of the ink print head in which the ink is heated by a heater disposed in the ink chamber, to generate minute bubbles used for jetting the fine ink particles.

Referring to FIGS. 6 and 7 showing an example of the above type of the ink jet print head utilizing the displacement of the piezoelectric/electrostrictive element, a nozzle plate 4 having a plurality of nozzles 2, an orifice plate 8 having a plurality of orifices 6, and a channel plate 10 are superposed on each other such that the channel plate 10 is interposed between the plates 4 and 8. These plates 4, 8, 10 are bonded together into an ink nozzle member 16, in which are formed ink discharge channels 12 for leading or guiding an ink material to the respective nozzles 2, and an ink supply channel or channels 14 for leading the ink material to the orifices 6. The ink jet print head further includes an ink pump member 24 which consists of two plates 18, 24 formed in lamination on the ink nozzle member 16. The ink pump member 24 has a plurality of voids 22 which correspond to the nozzles 2 and orifices 6. With this ink pump member 24 superposed on and bonded to the ink nozzle member 16, an ink chamber 26 corresponding to each of the voids 22 is formed behind the corresponding nozzle and orifice 2, 6. The ink pump member 24 includes a plurality of piezoelectric/electrostrictive elements 28 each fixedly formed on a relatively thin portion of the pump member 24 defining the corresponding ink chamber 26. In this ink jet print head, the ink nozzle member 16 consisting of the nozzle plate 4, orifice plate 8 and channel plate 10 is generally made of metal, such as stainless steel, in view of the manufacturing cost and the easiness of precision processing on the plates. As shown in FIG. 6, the nozzle plate 4 consists of a first nozzle plate 4*a* having tapered sections of the nozzles 2, and a second nozzle plate 4*b* having straight sections of the nozzles 2.

The ink pump member 24 of the ink jet print head of the above type may favorably consist of a piezoelectric/electrostrictive film type actuator made principally of a ceramic material, as disclosed in JP-A-3-128681 assigned to the assignee of the present application. This piezoelectric/electrostrictive film type actuator has a ceramic substrate corresponding to the above-indicated plates 18, 20, and a piezoelectric/electrostrictive element formed on one of opposite major surfaces of the ceramic substrate. The piezoelectric/electrostrictive element consists of a first electrode film, a piezoelectric/electrostrictive film and a second electrode film, which are laminated in this order to form an integral laminar structure. The actuator of this type is advantageously small-sized and cheap, and assures high operating reliability. Further, this actuator is excellent in its ability to generate a large amount of displacement by application of a relatively low voltage thereto, with a sufficiently large magnitude of force generated, assuring an improved operating response. Thus, the actuator as described above can be advantageously used as the ink pump member of the ink jet print head.

The inventors of the present invention made an analysis on the ink jet print head formed by superposing the metallic nozzle member having the nozzles for jetting the ink material, on the ink pump member in the form of the piezoelectric/electrostrictive film type actuator as described above. It was revealed as a result of the analysis that the amount of displacement of the ink pump member incorporated in the print head is significantly smaller than the nominal or intended amount of displacement of the actuator itself.

In the case where the ink jet print head is formed such that the ink pump member made of ceramic and the nozzle member made of stainless steel are bonded together at a temperature of 120° C. with an adhesive, for example, the ink pump member incorporated in the print head undergoes a displacement of 0.20 μm upon application of a given voltage thereto, whereas the ink pump member as formed separately from the print head undergoes a displacement of 0.30 μm upon application of the same voltage. Thus, the amount of displacement of the ink pump member is reduced as large as more than 30% after the pump member is incorporated in the print head.

SUMMARY OF THE INVENTION

In view of the above situation, the inventors of the present invention made various analyses on the reduction of the displacement of the ink pump member, which results in deterioration of the ink jetting capability of the ink jet print head. It was revealed as a result of the analyses that the ink pump member is subject to thermal stresses generated therein, or thermal strain remaining therein, due to the heat history during the process of fabricating the print head or due to the heat application to the fabricated print head, since the nozzle member and ink pump member of the head are made of different materials, that is, metal and ceramic, which have different coefficients of thermal expansion. Consequently, the ink pump member undergoes flexural deformation or compression, due to the thermal stresses or strains, resulting in undesirably reduced amount of displacement of the ink pump member.

It is therefore an object of the present invention to provide an ink jet print head having an ink pump member which ensures a sufficiently large amount of displacement thereof upon application of a given voltage thereto, thereby assuring improved ink jetting capability of the print head.

The above object may be accomplished according to the principle of the present invention, which provides an ink jet print head comprising: a metallic nozzle member having a plurality of nozzles through which fine particles of ink are jetted; a ceramic ink pump member superposed on and bonded to one of opposite major surfaces of the nozzle member, the ink pump member having a plurality of ink chambers formed behind the respective nozzles of the nozzle member, said ink pump member including a plurality of piezoelectric/electrostrictive elements each disposed on a portion of the ink pump member defining the corresponding one of the ink chambers, for deforming the portion so as to change a pressure of the corresponding ink chamber, whereby the ink supplied to the ink chamber is jetted through the corresponding one of the nozzles; and a CTE adjusting member superposed on and bonded to at least one of the nozzle member and the ink pump member, for reducing a stress which is applied to the ink pump member due to a difference between a coefficient of thermal expansion of the nozzle member and that of the ink pump member.

According to one form of the present invention, the CTE adjusting member is superposed on and bonded to the other surface of the nozzle member remote from the ink pump member. The coefficient of thermal expansion of the CTE adjusting member is smaller than that of the nozzle member, or is even smaller than that of the ink pump member which is smaller than that of the nozzle member. With the ink pump member and CTE adjusting member having relatively small coefficients of thermal expansion being formed on the opposite surfaces of the nozzle member having a large coefficient of thermal expansion, the present print head has a laminate of three members with small-large-small coefficients of thermal expansion, whereby the thermal deformation as encountered in a bimetal can be restricted. To assure excellent printing characteristics of the ink jet print head, it is desirable that the thickness of the CTE adjusting member is as small as possible. Therefore, the CTE adjusting member is preferably formed of a material having the possibly smallest coefficient of thermal expansion and a comparatively high Young's modulus, so as to yield a desired CTE adjusting effect even with the small thickness. The nozzle member is usually formed of a material having a larger coefficient of thermal expansion than a ceramic material. However, when the nozzle member is formed of a material having a smaller coefficient of thermal expansion than a ceramic material, the print head is desirably constituted by a laminate of three members with large-small-large coefficients of thermal expansion. Namely, in this particular case, the coefficient of thermal expansion of the CTE adjusting member is preferably larger than that of the nozzle member.

According to another form of the invention, the CTE adjusting member is superposed on and bonded to one major surface of the ink pump member remote from the nozzle member. In this case, the coefficient of thermal expansion of the CTE adjusting member may be larger than that of the ink pump member, preferably, is equivalent to that of the nozzle member. Alternatively, the CTE of the CTE adjusting member may be smaller than that of the ink pump member. In either case, the CTE adjusting member serves to effectively restrict the flexural deformation of the ink pump member due to a difference in the thermal expansion and contraction characteristics between the ink pump member and the nozzle member.

According to a further form of the invention, the CTE adjusting member is interposed between and bonded to the ink pump member and the nozzle member. In this case, the CTE adjusting member is formed of a material having a smaller coefficient of thermal expansion than the nozzle member. In this arrangement, the CTE adjusting member serves to effectively restrict or reduce the thermal deformation induced by the nozzle member having the larger coefficient of thermal expansion, to thereby reduce stresses which take place in the ink pump member.

In the ink jet print head constructed according to the present invention, the CTE adjusting member is superposed on and bonded to at least one of the ink pump member and nozzle member, to cooperate with these members to constitute an integral laminar structure. Therefore, the CTE adjusting member can effectively alleviate or reduce compressive stresses or tensile stresses applied to the ink pump member due to a difference of the coefficient of thermal expansion between the metallic nozzle member and the ceramic ink pump member. In particular, the CTE adjusting member is able to effectively restrict flexural deformation of the ink pump member resulting from such stresses, so that the ink pump member can be effectively displaced by the piezoelectric/electrostrictive element, whereby the present ink jet print head exhibits significantly improved ink jetting capability.

As described above, the coefficient of thermal expansion of the CTE adjusting member used for the present invention needs to be appropriately selected depending upon the position of the CTE adjusting member in the print head. In any case, the CTE adjusting member can effectively reduce stresses applied to the ink pump member due to the heat history during the process of producing the print head. The CTE adjusting member can also effectively reduce stresses which are applied to the ink pump member due to a difference of the coefficient of thermal expansion between the nozzle member and ink pump member, when the print head is heated after it is fabricated. Consequently, the present ink jet print head is advantageously free from an adverse influence of the stresses present in the ink pump member on its ink jetting capability.

BRIEF DESCRIPTION OF THE DRAWINGS

The above and optional objects, features and advantages of the present invention will be better understood by reading the following detailed description of presently preferred embodiments of the invention, when considered in connection with the accompanying drawings, in which.

DETAILED DESCRIPTION OF THE PREFERRED EMBODIMENTS

Figure 1:
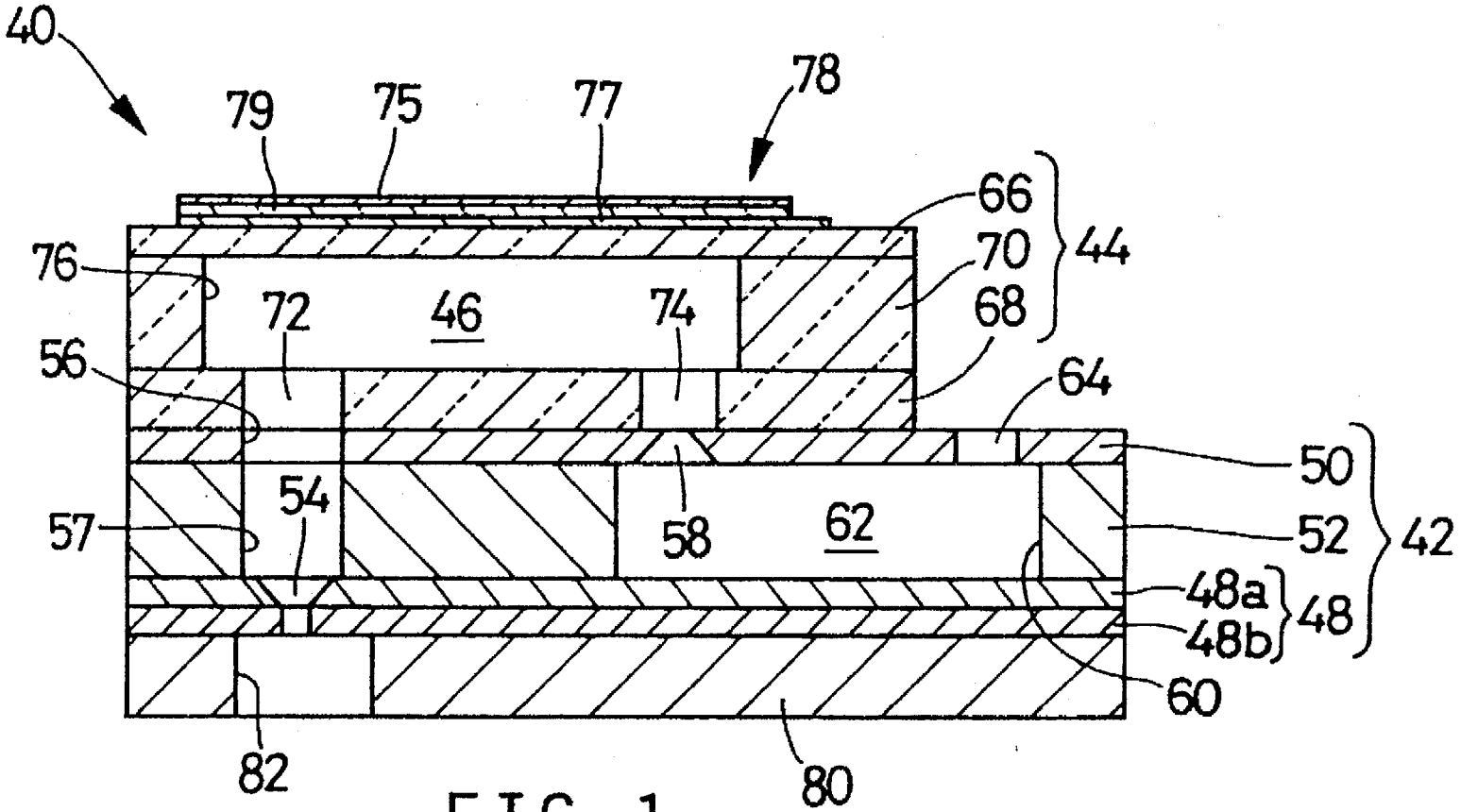
FIG. 1 is an elevational view in vertical cross section of one embodiment of an ink jet print head of the present invention.
Figure 2:
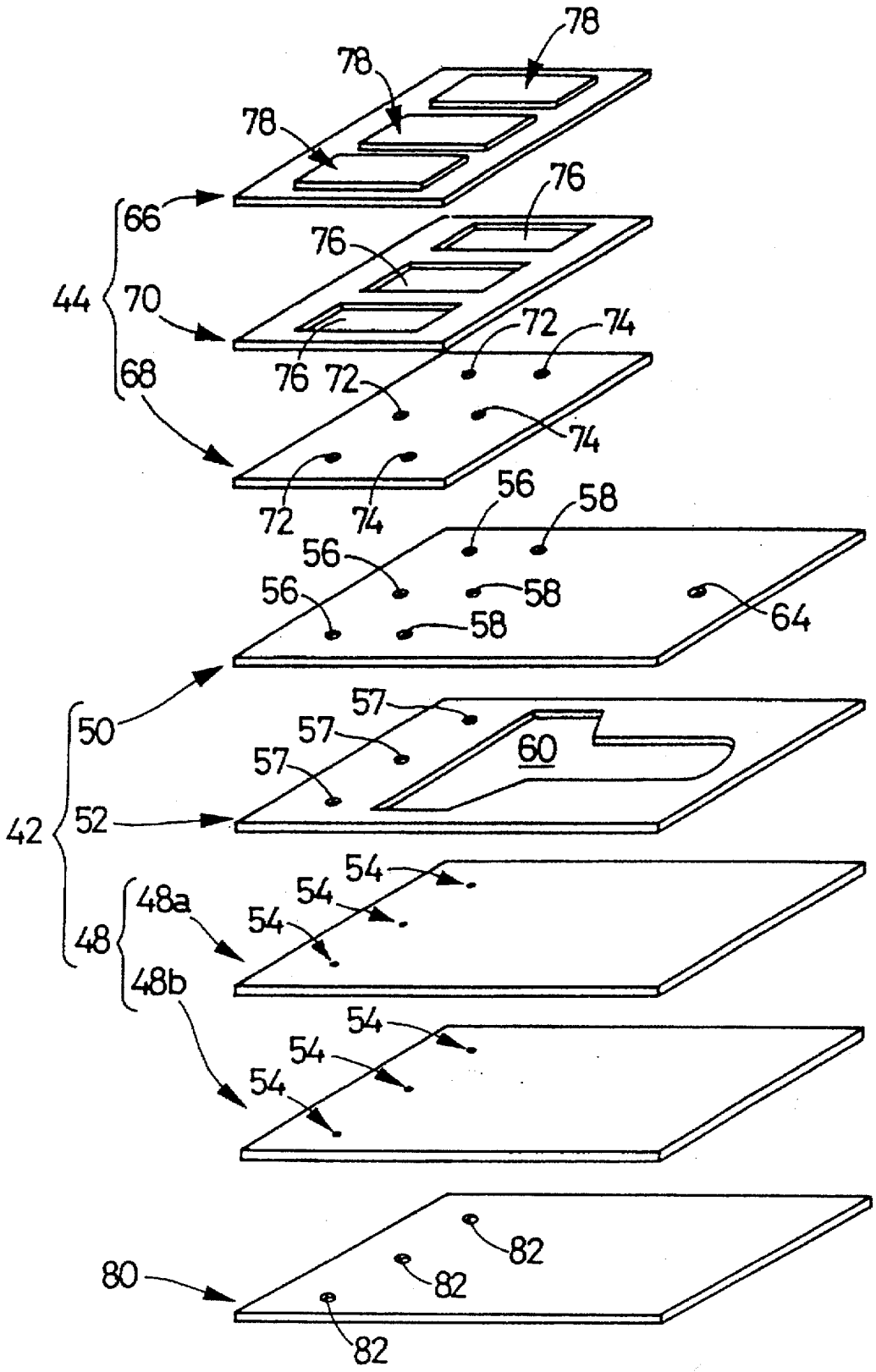
FIG. 2 is an exploded perspective view explaining the structure of the ink jet print head of FIG. 1.

Referring to FIG. 1 schematically showing in cross section an ink jet print head 40 as one preferred embodiment of the present invention, and to FIG. 2 which is an exploded perspective view of the print head 40, an ink nozzle member 42 and an ink pump member 44 are bonded together to form an integral structure of the ink jet print head 40. In this print head 40, an ink material is supplied to a plurality of ink chambers 46 formed in the ink pump member 44, and is jetted or discharged from a plurality of nozzles 54 formed through the ink nozzle member 42. The present print head further includes a CTE (coefficient of thermal expansion) adjusting plate 80 having a suitable thickness, which is bonded to one of the opposite major surfaces of the ink nozzle member 42 remote from the ink pump member 44, in other words, to the surface of the nozzle member 42 through which the ink is jetted.

More specifically described, the ink nozzle member 42 consists of a metallic nozzle plate 48 and a metallic orifice plate 50 which are relatively thin flat plates, and a metallic channel plate 52 interposed between these plates 48, 50. The nozzle plate 48 and the orifice plate 50 are integrally bonded to the channel plate 52 with a suitable adhesive. The nozzle plate 48 is formed by bonding a first nozzle plate 48*a* having tapered holes, and a second nozzle plate 48*b* having straight holes, such that the nozzle plate 48 have a plurality of nozzles 54 (three in this embodiment) for permitting jets of fine ink particles, each nozzle 54 consisting of one tapered hole and one straight hole of the respective plates 48*a*, 48*b*. The orifice plate 50 and the channel plate 52 have respective through-holes 56, 57 formed through the thickness thereof. These through-holes 56, 57 are aligned with the respective nozzles 54 as viewed in the direction of the thickness of the plates 48, 50, 52, and have a diameter which is larger by a given value than that of the nozzles 54.

The orifice plate 50 further has a plurality of orifices 58 (three in this embodiment) formed therethrough, for permitting flow of the ink into the respective ink chambers 46. The channel plate 52 is formed with a window 60 which is closed at its opposite openings by the nozzle plate 48 and orifice plate 50, respectively, whereby an ink supply channel 62 communicating with the orifices 58 is defined by the channel plate 52, nozzle plate 48 and orifice plate 50. The orifice plate 50 further has a supply port 64 through which the ink is fed from an ink reservoir into the ink supply channel 62.

The plates 48, 50, 52 of the ink nozzle member 42 are preferably formed of a metallic material, such as nickel or stainless steel. With the plates 48, 50 made of metal, the nozzles 54 and orifices 58 can be formed through the respective plates 48, 50 with high dimensional accuracy. Each of the orifices 58 is desirably formed in tapered shape such that the diameter of the orifice 58 is reduced in the direction of flow of the ink (i.e., the direction from the ink supply channel 62 toward the ink chambers 46), as shown in FIG. 1 by way of example, so as to function as a check valve for reducing the ink from flowing in the reverse direction. In the instant embodiment, the plates 48, 50 and 52 are made of stainless steel (SUS304), and fine holes like the nozzles and orifices 54, 58 are formed by punching, while the contours of the plates 48, 50, 52 are established by a combination of photolithography and etching. Then, these plates 48, 50 and 52 are bonded together by an epoxy-type adhesive, for example, to thereby form the integral ink nozzle member 42.

Other than the epoxy-type adhesive as indicated above, the adhesive used herein may consist of a hot-melt type adhesive film containing nylon or polyolefin, provided the adhesive is sufficiently resistant to heat generated in the subsequent heat treatment step needed for bonding the plates 48, 50, 52 together.

The ink pump member 44 includes a closure plate 66 and a connecting plate 68 which are relatively thin flat plates, and a spacer plate 70 interposed between the plates 66, 68. These plates 66, 68, 70 are superposed on each other and formed integrally into the ink pump member 44.

The connecting plate 68 has first communication holes 72 and second communication holes 74 formed therethrough, which are respectively aligned with the through-holes 56 and orifices 58 formed in the orifice plate 50, as viewed in the direction of the thickness of the plates 68, 50. The diameter of the first communication holes 72 is substantially equal to or slightly larger than that of the through-holes 56, while the diameter of the second communication holes 74 is larger by a given value than that of the orifices 58.

The spacer plate 70 has a plurality of rectangular windows 76 formed therethrough. The spacer plate 70 is superposed on the connecting plate 68 such that each of the windows 76 communicates with the corresponding first and second communication holes 72, 74 formed in the connecting plate 68.

On one major surface of the spacer plate 70 remote from the connecting plate 68, there is superposed the above-indicated closure plate 66 for closing the openings of the windows 76. Thus, the above-indicated ink chambers 46 are formed in the ink pump member 44, such that the chambers 46 communicate with an exterior space through the first and second communication holes 72, 74.

The ink pump member 44 is formed as an integrally formed fired ceramic structure. More specifically, green sheets as precursors for the closure plate 66, connecting plate 68 and spacer plate 70 are initially formed, laminated on each other, and then fired into an integral ceramic body as the ink pump member 44. While the ceramic material used for forming the ink pump member 44 is not limited to any particular kinds, alumina, zirconia and the like may be favorably employed in view of its formability and other properties. In this embodiment, the ink pump member 44 is formed of zirconia which contains 3 mol % of $Y_2O_3$. The closure plate 66 has a thickness of 10 μm, and the connecting plate 68 has a thickness of 180 μm, while the spacer plate 70 has a thickness of 180 μm.

The ink pump member 44 further has piezoelectric/electrostrictive elements 78 formed on the outer surface of the closure plate 66, such that the elements 78 correspond to the respective ink chambers 46 formed in the member 44. Each of the piezoelectric/electrostrictive elements 78 has a piezoelectric/electrostrictive unit consisting of a lower electrode 75, a piezoelectric/electrostrictive layer 79 and an upper electrode 77, which are formed in lamination on the closure plate 66, by a suitable film-forming method. As the piezoelectric/electrostrictive element 78 of the instant embodiment, it is particularly preferable to employ a piezoelectric/electrostrictive element as proposed in co-pending U.S. patent application No. 07/912,920 assigned to the same assignee as the present application.

More specifically, films of the lower and upper electrodes 75, 77 and piezoelectric/electrostrictive layers 79 are formed on the outer surface of the closure plate 66, by any one of various known methods which include thick-film forming processes, such as screen printing, spraying, dipping and coating, and thin-film forming processes, such as ion-beam method, sputtering, vacuum vapor deposition, ion plating, CVD and plating. The formation of these layers 75, 77, 79 may be effected either before or after sintering of the closure plate 66 (the ink pump member 44). Then, the electrode films 75, 77 and piezoelectric/electrostrictive layer 79 thus formed on the closure plate 66 may be heat-treated as needed, either in different steps following formation of the respective films and layer 75, 77, 79, or in one step following formation of all the films and layer 75, 77, 79.

The electrode films 75, 77 of each piezoelectric/electrostrictive unit may be formed of any electrically conductive material which can withstand a high-temperature oxidizing atmosphere generated upon the heat-treatment or firing as described above. For instance, the electrode films 75, 77 may be formed of a single metal, an alloy of metals, a mixture of a metal or alloy and an insulating ceramic or glass, or an electrically conductive ceramic. Preferably, the electrode material contains as a major component a noble metal having a high melting point, such as platinum, palladium or rhodium, or an alloy such as silver-palladium alloy, silver-platinum alloy or platinum-palladium alloy.

The piezoelectric/electrostrictive layer 79 of each piezoelectric/electrostrictive unit may be formed of any piezoelectric or electrostrictive material which produces a relatively large amount of strain or displacement due to the converse or reverse piezoelectric effect or the electrostrictive effect. The piezoelectric/electrostrictive material may be either a crystalline material or an amorphous material, and may be a semi-conductor material or a dielectric or ferroelectric ceramic material. Further, the piezoelectric/electrostrictive material may either require a treatment for initial polarization or poling, or may not require such a polarization treatment.

The piezoelectric/electrostrictive material used for the piezoelectric/electrostrictive layer 79 preferably contains as a major component lead zirconate titanate (PZT), lead magnesium niobate (PMN), lead nickel niobate (PNN), lead manganese niobate, lead antimony stannate, lead zinc niobate, lead titanate, or a mixture thereof. The piezoelectric/electrostrictive material having the above major component may further contain as an additive an oxide or other compound of lanthanum, strontium, barium, niobium, zinc, cerium, cadmium, chromium, cobalt, antimony, iron, yttrium, tantalum, tungsten, nickel, and/or manganese, so as to provide a material containing PLZT, for example.

The piezoelectric/electrostrictive unit consisting of the electrodes 75, 77 and piezoelectric/electrostrictive layer 79 generally has a thickness of not larger than 100 μm. The thickness of each electrode 75, 77 is generally 20 μm or smaller, preferably 5 μm or smaller. To assure a relatively large amount of displacement with a relatively low voltage, the thickness of the piezoelectric/electrostrictive layer 79 is preferably 50 μm or smaller, more preferably, within a range of 3 μm to 40 μm. In this embodiment, the piezoelectric/electrostrictive layer 79 has a thickness of 30 μm, and is formed of a material which contains lead magnesium niobate, lead zirconate and lead titanate as major components. The upper electrode 75 consists of a copper layer and a chromium layer and formed by sputtering, and the lower electrode 77 is formed by printing and firing a platinum paste.

Further, the above-indicated CTE adjusting plate 80 is integrally bonded to the outer surface of the nozzle plate 48 of the ink nozzle member 42. The CTE adjusting plate 80 has a plurality of through-holes 82 formed therethrough, which are aligned with the nozzles 54 formed in the nozzle plate 48, as viewed in the direction of the thickness of the plates 48, 80. The through-holes 82 have a larger diameter than that of the nozzles 54, so as not to interrupt the ink jetting from the nozzles 54. This CTE adjusting plate 80 serves to reduce the stress that is applied to the ink pump member 44 and then to the piezoelectric/electrostrictive element 78 due to a difference in the coefficient of thermal expansion between the ink nozzle member 42 and the ink pump member 44. The CTE adjusting plate 80 is preferably formed of a material having a smaller coefficient of thermal expansion than the metallic ink nozzle member 42, and more preferably formed of a material having a smaller coefficient of thermal expansion than the ink pump member 44 whose CTE is smaller than that of the ink nozzle member 42. Generally, the CTE adjusting plate is formed of a ceramic material such as alumina.

The material and dimensions (e.g., thickness) of the CTE adjusting plate 80 may be optimally selected or determined depending upon those of the ink nozzle member 42 and ink pump member 44. More specifically, the material and dimensions of the CTE adjusting plate 80 are generally selected in view of the apparent coefficient of thermal expansion (CTE) of the ink pump member 44, and the apparent CTE and the rigidity of the ink nozzle member 42, in an attempt to restrain the thermal expansion and contraction of the ink nozzle member 42 to be commensurate with the CTE of the ink pump member 44. The rigidity of the ink nozzle member 42 is determined by the Young's modulus and the shape of the nozzle member 42. Then, the material and dimensions of the plate 80 are more specifically determined by experiments. In particular, the CTE adjusting plate 80 is preferably made of a material which has a relatively high Young's modulus, and exhibits the apparent coefficient of thermal expansion that is substantially equal to the CTE of the ink pump member 44, when measured after the adjusting plate 80 is bonded to the nozzle member 42. The higher the Young's modulus of the CTE adjusting plate 80 is, the smaller thickness of the plate 80 is needed for achieving sufficiently high rigidity. The CTE adjusting plate 80 desirably has a small thickness since a sufficiently large distance can be maintained between the ink jet print head and a recording medium. In this context, the CTE adjusting plate 80 desirably has a thickness of about 0.1 mm or smaller. In the instant embodiment, the CTE adjusting plate 80 consists of a 96% alumina plate having a thickness of 280 μm, which is formed by a tape forming method, punching and firing.

Alumina which provides the CTE adjusting plate 80 of the ink jet print head of the instant embodiment has a coefficient of thermal expansion of about $8\times10^{-6}$/°C. This CTE of the alumina is lower than that of zirconia ($10\times10^{-6}$/°C.) which mainly forms the ink pump member 44 of this embodiment, and is also lower than the CTE of SUS304 ($16\times10^{-6}$/°C.) which forms the ink nozzle member 42. Accordingly, the apparent coefficient of thermal expansion of the bonded assembly of the ink nozzle member 42 and the CTE adjusting plate 80 can be made substantially equal to the CTE of the ink pump member 44, by properly controlling the thickness of the CTE adjusting plate 80. In the instant embodiment, the thickness of the CTE adjusting plate 80 is controlled to be 280 μm as a result of simple calculation. It is more desirable to determine the thickness of the CTE adjusting plate 80 based on data obtained by experiments, or by computer simulation.

The adhesive used for bonding the ink nozzle member 42 and ink pump member 44 may be selected from various known adhesives, such as those of vinyl-type, acrylic-type and epoxy-type, or those containing polyamide, phenol, resorcinol, urea, melamine, polyester, furan, polyurethane, silicone, rubber, polyimide and polyolefin, provided the selected adhesive is resistant to the ink material.

It is desirable in terms of production efficiency that the adhesive is in the form of a highly viscous paste which can be applied by coating using a dispenser, or by screen-printing, or is in the form of a sheet which permits punching therethrough. The adhesive in the form of a highly viscous paste may be obtained by mixing an adhesive material with a filler to thereby increase the viscosity of the resulting adhesive.

A sample of the ink jet print head 40 constructed as shown in FIGS. 1 and 2 was produced in the following manner. Initially, the ink pump member 44, ink nozzle member 42 and CTE adjusting plate 80 were prepared according to the instant embodiment. Then, these members and plate 44, 42, 80 were stacked at a pressure of 2 kg/cm$^2$, and bonded together at 120° C. for an hour, by using an epoxy type adhesive. As a comparative sample, there was produced an ink jet print head which is not provided with the CTE adjusting plate 80. The thus obtained two specimens of ink jet print heads were evaluated by measuring the amount of displacement of the piezoelectric/electrostrictive element 78 of each head when a given voltage is applied to the element 78. The measurement revealed that the ink jet print head 40 having the CTE adjusting plate 80 exhibited a displacement of 0.28 μm whereas the print head as the comparative sample having no CTE adjusting plate exhibited a displacement of as small as 0.21 μm.

In the ink jet print head 40 constructed according to the present invention, the CTE adjusting plate 80 serves to effectively reduce or eliminate stresses due to the difference in the coefficient of thermal expansion between the ink nozzle member 42 and the ink pump member 44, which stresses are tensile stresses caused by flexural deformation of the ink pump member 44 in the above-described embodiment. Accordingly, the ink pump member 44 and the piezoelectric/electrostrictive element 78 undergo desired amounts of displacement thereof without suffering from the stress applied to the pump member 44. Consequently, the present print head 40 assures significantly improved operating characteristics of the ink pump member 44, and accordingly improved ink jetting capability.

In the ink jet print head 40 as described above, the material for the piezoelectric/electrostrictive element 78 disposed on the ink pump member 44 is different from the material for the closure plate 66, connecting plate 68 and spacer plate 70 of the ink pump member 44. In the process of producing the print head 40, therefore, thermal stresses remain in the piezoelectric/electrostrictive element 78, in particular, in the piezoelectric/electrostrictive layer 79, due to the difference of the CTE between these different materials for the element 78 and pump member 44. Such thermal stresses can also be effectively reduced by the CTE adjusting plate 80, resulting in improved durability of the piezoelectric/electrostrictive layer 79, and improved displacement characteristics of the piezoelectric/electrostrictive element 78 and the ink pump member 44.

Figure 3:
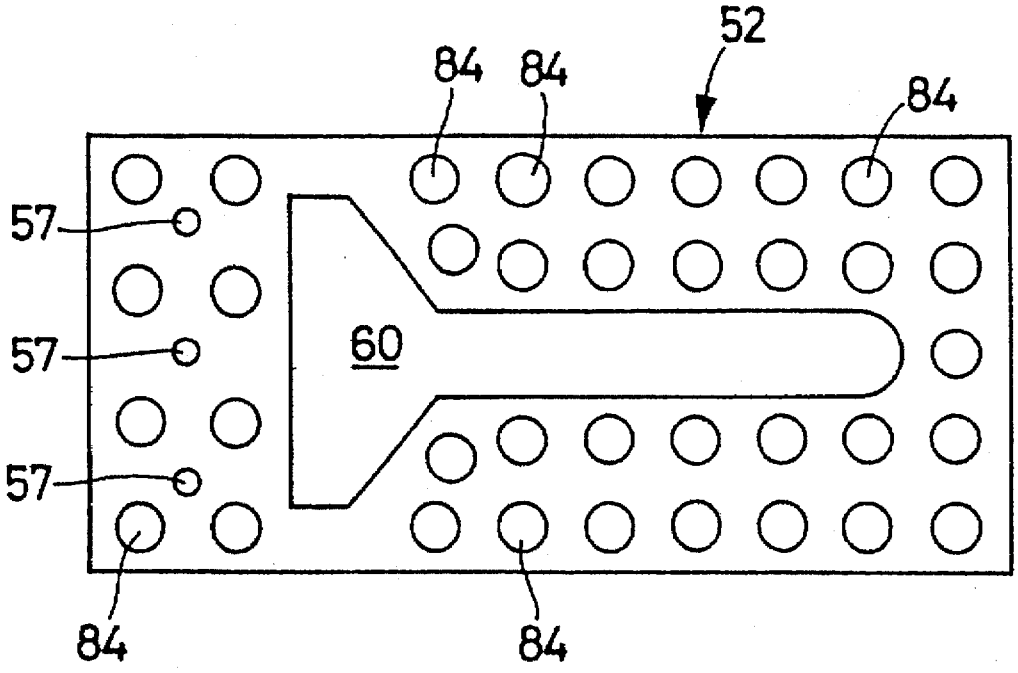
FIG. 3 is a plan view showing an example of a channel plate of an ink nozzle member of the ink jet print head of FIG. 1.

As described above, it is desirable to reduce the thickness of the CTE adjusting plate 80 to a minimum. FIG. 3 shows another embodiment of the invention which includes a means for reducing the thickness of the CTE adjusting plate 80. In this figure, there is illustrated another form of the channel plate 52 of the ink nozzle member 42 of the ink print head as shown in FIGS. 1 and 2. This channel plate 52 is formed of 42% Ne-Fe alloy having a coefficient of thermal expansion of $7\times10^{-6}$/°C., which is smaller than that of SUS304. The channel plate 52 has a multiplicity of holes 84 formed therethrough over the entire area of its surface except the window 60 and through-holes 57, as shown in FIG. 3, whereby the plate 52 has a mesh-like configuration and exhibits relatively low rigidity.

On the other hand, the CTE adjusting plate 80 of the instant embodiment is formed of a material having 96% of alumina, and has a thickness of 100 μm. When a given voltage is applied to the piezoelectric/electrostrictive element 78 of this embodiment, the element 78 undergoes a displacement of 0.28 μm, which is equivalent to that obtained in the previous embodiment, even though the thickness (100 μm) of the CTE adjusting plate 80 is smaller than that of the plate 80 of the previous embodiment.

In the manner as described above, the thickness of the CTE adjusting plate 80 can be further reduced by optimally designing the shape of the channel plate 52. In the extreme case, the thickness of the CTE adjusting plate 80 can be reduced to zero, by suitably selecting the material of the channel plate 52 and/or optimally designing other portions of the print head, so as to appropriately control the thermal stress in the print head. In this case, the channel plate 52 per se can be considered as the CTE adjusting plate.

In the illustrated embodiments, the CTE adjusting plate 80 is superposed on the surface of the ink nozzle member 42 which is opposite to the surface thereof to which the ink pump member 44 is bonded. However, the location of the CTE adjusting member (80) in the ink jet print head of the present invention may be suitably selected as needed, provided the adjusting member (80) is able to reduce the stress applied to the ink pump member 44 due to the difference of the coefficient of thermal expansion between the ink nozzle member 42 and the ink pump member 44. In another embodiment of the invention as shown in FIGS. 4 and 5, a plate-like CTE adjusting member 86 is superposed on and integrally bonded to the the surface of the ink pump member 44 which is opposite to the surface thereof to which the ink nozzle member 42 is bonded.

Figure 4:
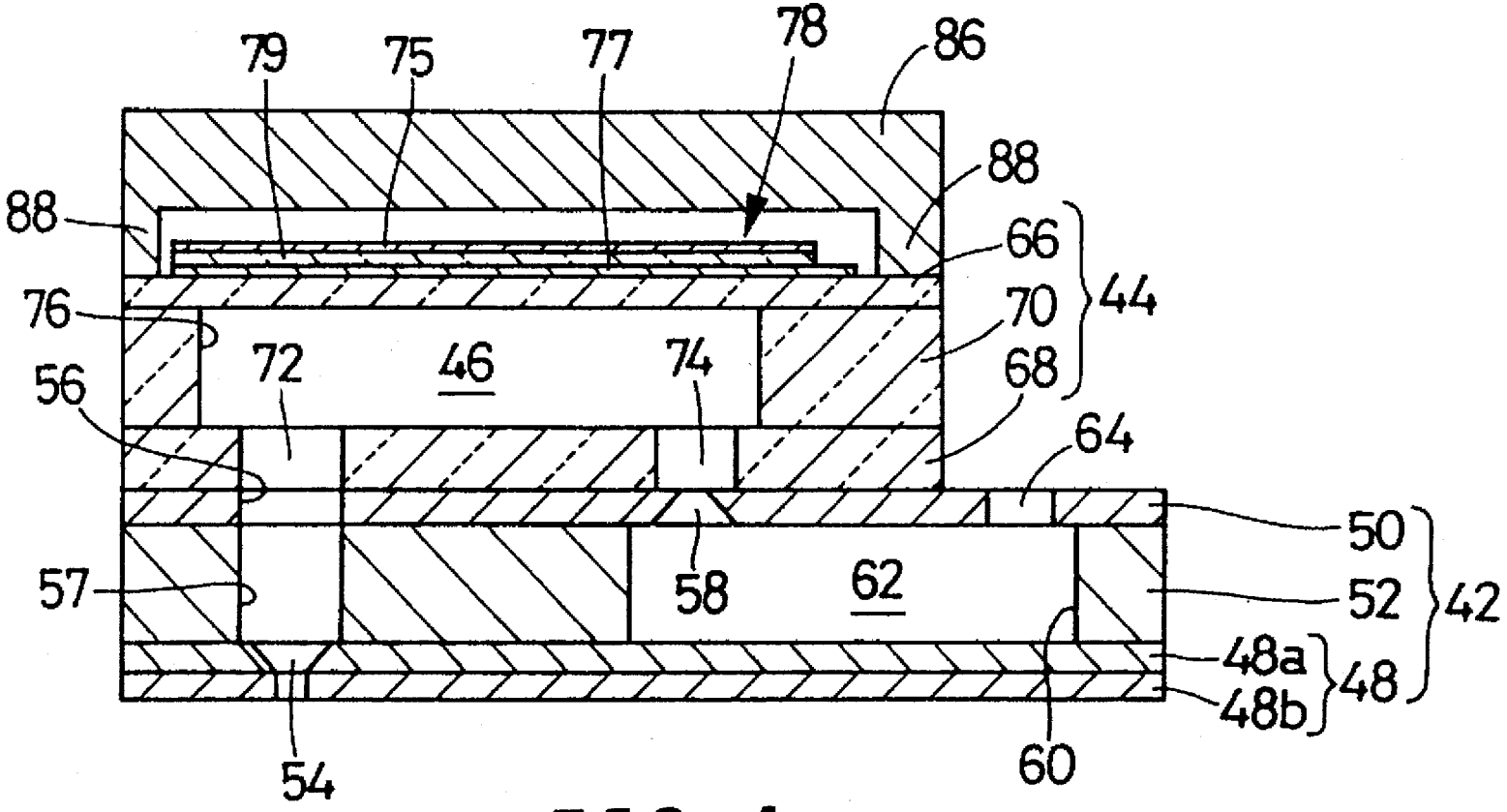
FIG. 4 is a vertical cross sectional view corresponding to that of FIG. 1, showing an ink jet print head as another embodiment of the present invention.
Figure 5:
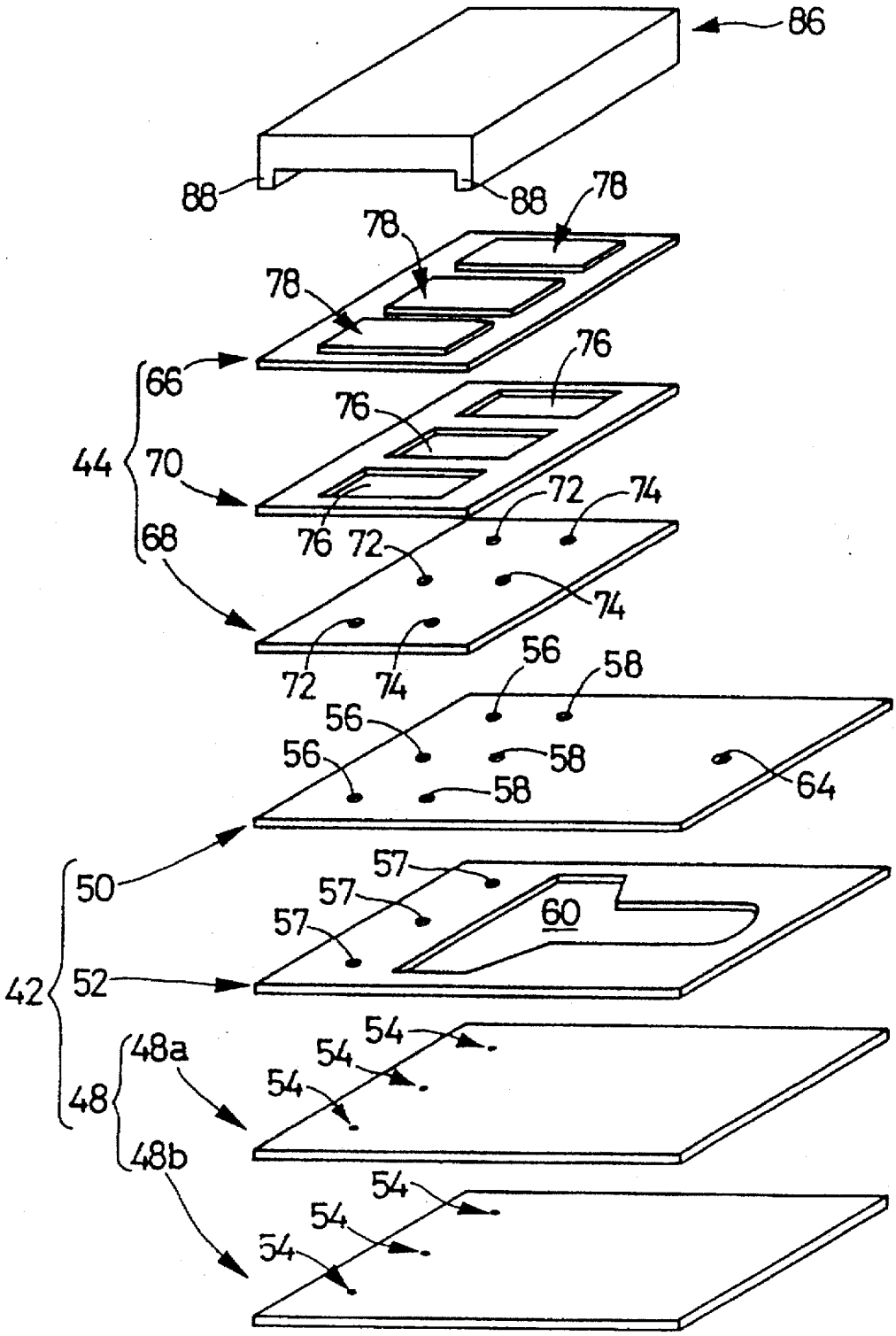
FIG. 5 is an exploded perspective view corresponding to that of FIG. 2, for explaining the structure of the ink jet print head of FIG. 4.
Figure 6:
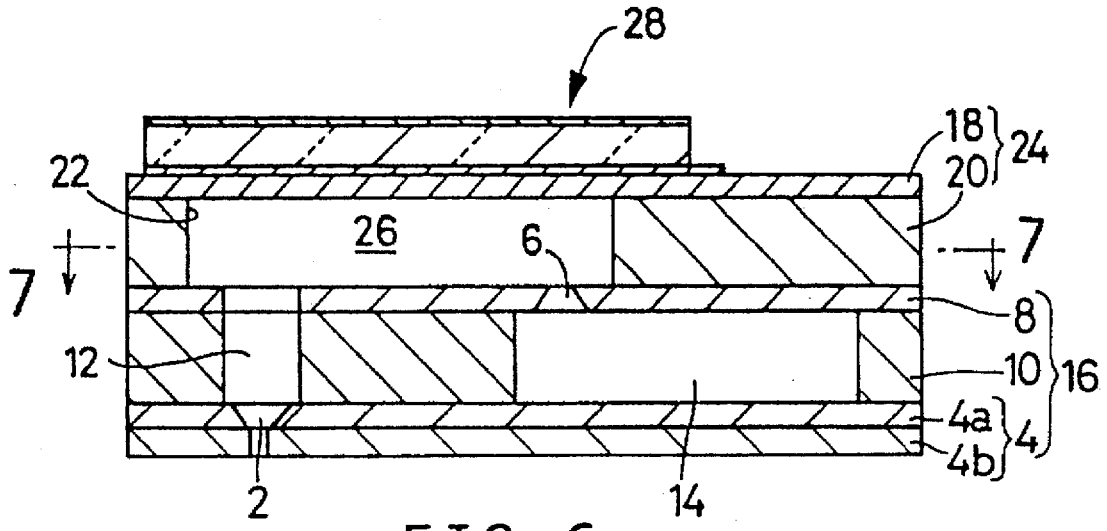
FIG. 6 is a vertical cross sectional view showing a known ink jet print head by way of example.
Figure 7:
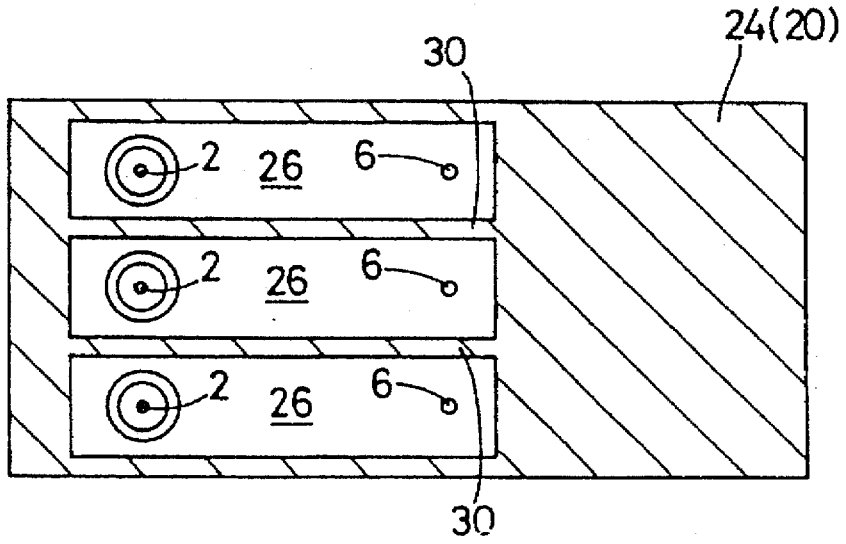
FIG. 7 is a cross sectional view taken along line 7—7 of FIG. 6.

The ink nozzle member 42 and the ink pump member 44 used in the first embodiment of FIGS. 1 and 2 are used in the instant embodiment of FIGS. 4 and 5. Namely, the instant embodiment is different from the first embodiment only in respect of the CTE adjusting member. As shown in FIGS. 4 and 5, the CTE adjusting member 86 of this embodiment is provided on the side of the ink pump member 44 on which the piezoelectric/electrostrictive element 78 is provided, such that the adjusting member 86 passes over the element 78. More specifically, the CTE adjusting plate 86 takes the form of a lid having opposite leg portions 88, 88, which are bonded to the upper surface of the closure plate 66 of the ink pump member 44. Thus, the CTE adjusting plate 86 is formed as an integral part of the ink jet print head.

The CTE adjusting member 86 thus positioned in the print head may be formed of a material, such as alumina, which has a relatively small coefficient of thermal expansion (contraction), as in the first embodiment. When the CTE of the material of the CTE adjusting member 86 is smaller than that of the ink pump member 44, the CTE adjusting member 86 serves to effectively reduce or restrict the stress on the pump member 44, in other words, its flexural deformation, caused by the thermal expansion and contraction of the ink nozzle member 42 having a relatively large coefficient of thermal expansion. Alternatively, the CTE adjusting member 86 may be formed of a material having a larger coefficient of thermal expansion than the ink pump member 44. Particularly, the coefficient of thermal expansion of the CTE adjusting member 86 may be substantially equal to that of the ink nozzle member 42. In this case, too, the flexural deformation of the ink pump member 44 can be effectively reduced or restricted, assuring improved ink jetting capability of the ink jet print head.

To effectively alleviate the flexural deformation of the ink nozzle member 42 and ink pump member 44, the CTE adjusting member 86 used in the instant embodiment of FIGS. 4 and 5 is formed of stainless steel (SUS304) as used for the ink nozzle member 42, and has a thickness of 300 μm. The ink pump member 44 of the thus obtained ink jet print head undergoes a displacement of 0.29 μm when a given voltage is applied to the piezoelectric/electrostrictive element 78, whereas the ink pump member 44 of the ink jet print head which does not include the above-described CTE adjusting member 86 undergoes a displacement of as small as 0.21 μm. It will be readily understood that the provision of the CTE adjusting member 86 leads to significantly improved ink jetting capability of the ink jet print head.

Figure 8:
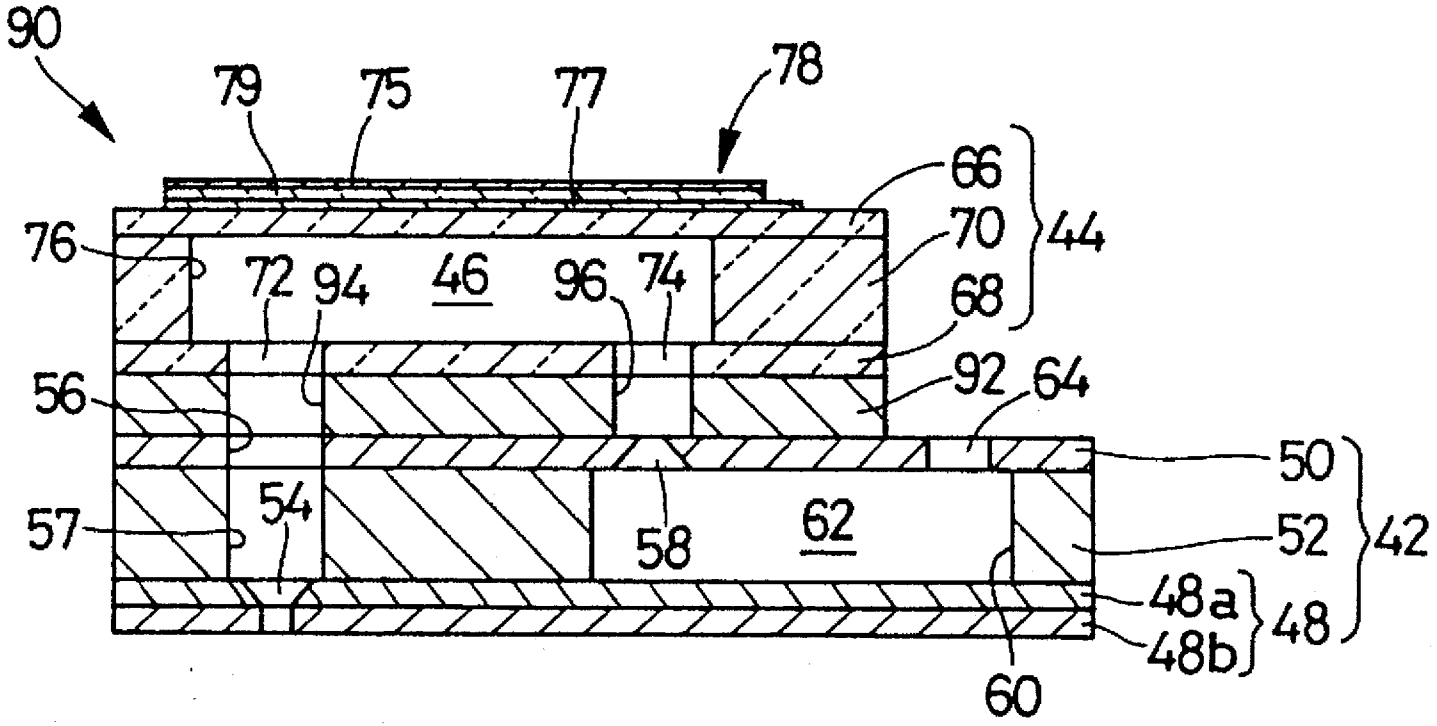
FIG. 8 is a vertical cross sectional view corresponding to that of FIG. 1, showing an ink jet print head as a further embodiment of the present invention.

Referring next to FIG. 8 showing an ink jet print head 90 as a further embodiment of the present invention, the print head includes the ink nozzle member 42 and the ink pump member 44 as used in the illustrated embodiments, and a CTE adjusting plate 92 interposed between the ink pump member 44 and ink nozzle member 42. More specifically, the CTE adjusting plate 92 is bonded at its opposite major surfaces to the connecting plate 68 of the ink pump member 44 and the orifice plate 50 of the ink nozzle member 42, such that the adjusting plate 92 is sandwiched between these plates 68, 50. The CTE adjusting plate 92 has a first set of through-holes 94 and a second set of through-holes 96 formed therethrough, which are respectively aligned with the first communication holes 72 and the second communication holes 74 formed through the connecting plate 68 of the ink pump member 44, as viewed in the direction of the thickness of the plates 68, 92. These through-holes 94 and 96 have substantially the same diameter of the communication holes 72 and 74, respectively. The ink chambers 46 of the ink pump member 44 are held in communication with the nozzles 54 and the orifices 58 of the ink nozzle member 42, via the respective sets of the through-holes 94, 96.

The CTE adjusting plate 92 used in this embodiment is formed of a material having a smaller coefficient of thermal expansion than the ink nozzle member 42. Preferably, the coefficient of thermal expansion of the CTE adjusting plate 92 is equivalent to that of the ink pump member 44. The CTE adjusting plate 92 thus provided in the print head serves to effectively reduce or eliminate tensile stresses based on the flexural deformation of the ink pump member 44 caused by the thermal expansion and contraction of the ink nozzle member 42 having a relatively large coefficient of thermal expansion. The thus constructed ink jet print head 90 is advantageous over the print head as shown in FIGS. 1 and 2, in that the thickness of the CTE adjusting plate 92 can be selected as desired without regard to restrictions on the distance between the nozzles of the print head and a recording medium. Further, the present ink jet print head 90 is advantageous over the print head as shown in FIGS. 4 and 5, since the CTE adjusting plate 92 does not place any restrictions on the design of the wiring on the surface of the closure plate 66 of the ink pump member 44.

Figure 9:
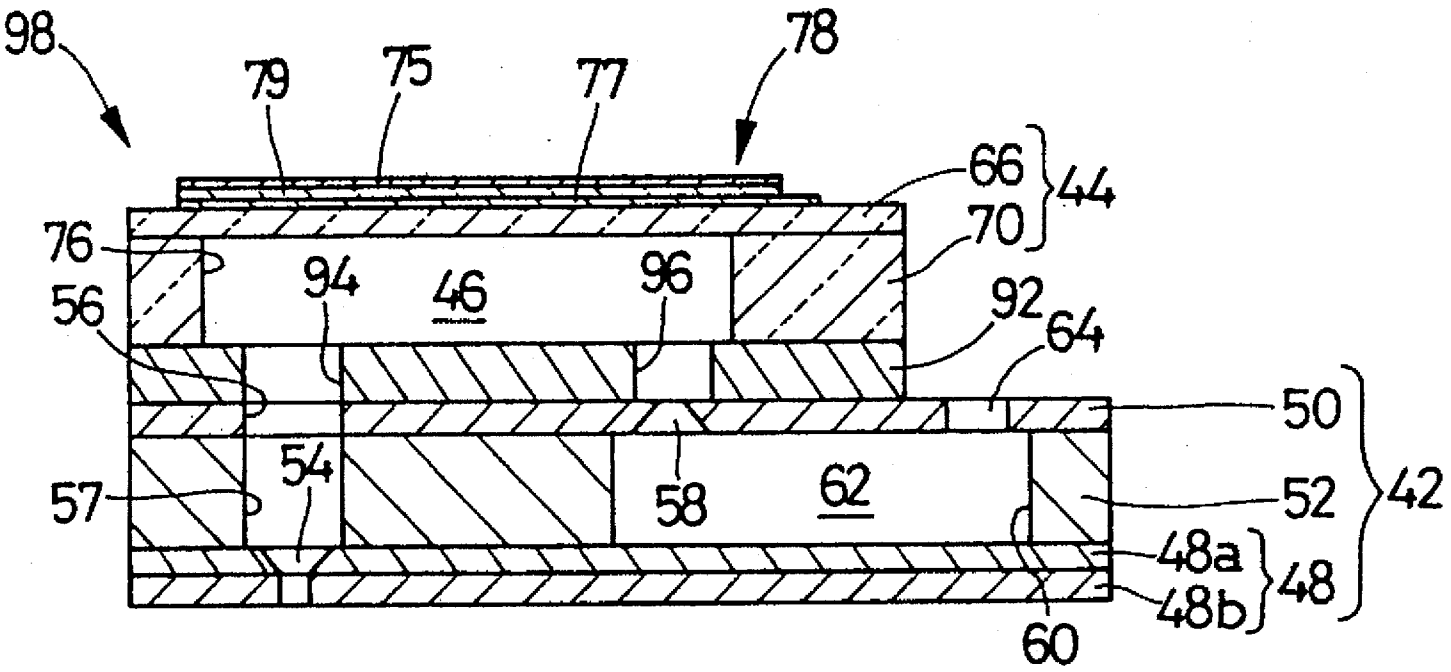
FIG. 9 is a vertical cross sectional view corresponding to that of FIG. 1, showing an ink jet print head as a still further embodiment of the present invention.

The ink jet print head 90 constructed as described above may be modified such that the CTE adjusting plate 92 and the connecting plate 68 of the ink pump member 44 are formed into an integral single member. Referring to FIG. 9 showing such modification by way of example, an ink jet print head 98 has a CTE adjusting plate 92 interposed between the orifice plate 50 of the ink nozzle member 42 and the spacer plate 70 of the ink pump member 44. The CTE adjusting plate 92 is bonded to the orifice and spacer plates 50, 70, and is thus formed as an integral part of the print head 98. In this embodiment, the connecting plate 68 is incorporated into the CTE adjusting plate 92.

To produce the ink jet print head 98, the ink pump member 44 which does not include the connecting plate 68 is first prepared, and then bonded to the CTE adjusting plate 92 and the ink nozzle member 42, so that the pump member 44 is formed as an integral part of the print head 98. In the thus obtained ink jet print head 98, tensile stresses due to the flexural deformation of the ink pump member 44 can be effectively reduced or eliminated, whereby the print head 98 exhibits effectively improved ink jetting capability.

While the present invention has been described in its presently preferred embodiments with a certain degree of particularity, it is to be understood that the invention is not limited to the details of the illustrated embodiments, but may be embodied with various changes, modifications and improvements, which may occur to those skilled in the art, without departing from the scope of the invention as defined in the appended claims.

For instance, the ink nozzle member 42 and the ink pump member 44 may employ various known structures other than those of the illustrated embodiments. While the ink supply channel 62 for supplying the ink material into the ink chambers 46 is formed within the ink nozzle member 42 in the illustrated embodiments, the ink supply channel 62 may be formed within the ink pump member 44.

Further, the location and number of the nozzles 54 and orifices 58, and the location and number of the ink chambers 46 may be suitably Selected as needed, depending upon the application of the ink jet print head, for example.

What is claimed is:

1. An ink jet print head comprising:

a metallic nozzle member having a plurality of nozzles through which fine particles of ink are jetted, and a first and a second opposite major surface;

a ceramic ink pump member having a first and a second opposite major surface, said ceramic pump member being superposed on and bonded to said nozzle member, the first opposite major surfaces of the nozzle member and the ceramic ink pump member being bonded together, said ink pump member having a plurality of ink chambers formed behind respective nozzles of said nozzle member, said ink pump member including a plurality of piezoelectric/electrostrictive elements each disposed on a portion of said ink pump member opposite a respective ink chamber, for deforming said portion so as to change a pressure of the respective ink chamber, whereby the ink supplied to the ink chamber is jetted through the corresponding one of said nozzles; and coefficient of thermal expansion adjusting means for reducing a stress which is applied to said ink pump member due to a difference between a coefficient of thermal expansion of said nozzle member and a coefficient of thermal expansion of said ink pump member, said coefficient of thermal expansion adjusting means comprising an adjusting member superposed on and bonded to at least one of said nozzle member and said ink pump member.

2. An ink jet print head comprising:

a metallic nozzle member having a plurality of nozzles through which fine particles of ink are jetted, and a first and a second opposite major surface;

a ceramic ink pump member having a first and a second opposite major surface, said ceramic pump member being superposed on and bonded to said nozzle member, the first opposite major surfaces of the nozzle member and a ceramic ink pump member being bonded together, said ink pump member having a plurality of ink chambers formed behind respective nozzles of said nozzle member, said ink pump member including a plurality of piezoelectric/electrostrictive elements each disposed on a portion of said ink pump member opposite a respective ink chamber, for deforming said portion so as to change a pressure of the respective ink chamber, whereby the ink supplied to the ink chamber is jetted through the corresponding one of said nozzles; and coefficient of thermal expansion adjusting means for reducing a stress which is applied to said ink pump member due to a difference between a coefficient of thermal expansion of said nozzle member and a coefficient of thermal expansion of said ink pump member, said coefficient of thermal expansion adjusting means comprising an adjusting member that is superposed on and bonded to the second opposite major surface of said nozzle member which is remote from said ink pump member, the coefficient of thermal expansion of said adjusting member being smaller than the coefficient of thermal expansion of said nozzle member.

3. An ink jet print head as defined in claim 2, wherein the coefficient of thermal expansion of said adjusting member is smaller than the coefficient of thermal expansion of said ink pump member.

4. An ink jet print head as defined in claim 2, wherein said adjusting member has a thickness of not larger than 0.1 mm.

5. An ink jet print head comprising:

a metallic nozzle member having a plurality of nozzles through which fine particles of ink are jetted, and a first and a second opposite major surface;

a ceramic ink pump member having a first and a second opposite major surface, said ceramic pump member being superposed on and bonded to said nozzle member, the first opposite major surfaces of the nozzle member and the ceramic ink pump member being bonded together, said ink pump member having a plurality of ink chambers formed behind respective nozzles of said nozzle member, said ink pump member including a plurality of piezoelectric/electrostrictive elements each disposed on and directly bonded to a portion of said ink pump member opposite a respective ink chamber, for deforming said portion so as to change a pressure of the respective ink chamber, whereby the ink supplied to the ink chamber is jetted through the corresponding one of said nozzles; and coefficient of thermal expansion adjusting means for reducing a stress which is applied to said ink pump member due to a difference between a coefficient of thermal expansion of said nozzle member and a coefficient of thermal expansion of said ink pump member, said coefficient of thermal expansion adjusting means comprising an adjusting member that is superposed on and bonded to the second opposite major surface of said ink pump member which is remote from said nozzle member.

6. An ink jet print head as defined in claim 5, wherein the coefficient of thermal expansion of said adjusting member is larger than the coefficient of thermal expansion of said ink pump member.

7. An ink jet print head as defined in claim 6, wherein the coefficient of thermal expansion of said adjusting member is equivalent to the coefficient of thermal expansion of said nozzle member.

8. An ink jet print head as defined in claim 5, wherein the coefficient of thermal expansion of said adjusting member is smaller than the coefficient of thermal expansion of said ink pump member.

9. An ink jet print head as defined in claim 5, wherein said adjusting member includes a pair of leg portions which are bonded to said second opposite major surface of said ink pump member, such that the adjusting member passes over said piezoelectric/electrostrictive element.

10. An ink jet print head as defined in claim 1, wherein said adjusting member is interposed between and bonded to said nozzle member and said ink pump member, the coefficient of thermal expansion of said CTE adjusting member being smaller than the coefficient of thermal expansion of said nozzle member.

11. An ink jet print head as defined in claim 10, wherein the coefficient of thermal expansion of said adjusting member is equivalent to the coefficient of thermal expansion of said ink pump member.

12. An ink jet print head as defined in claim 1, wherein said nozzle member consists of a nozzle plate having said plurality of nozzles, a channel plate having a window formed therethrough, and an orifice plate having a plurality of orifices formed therethrough, said ink pump member being superposed on said orifice plate, said window of said channel plate being closed by and between said nozzle plate and orifice plate to provide an ink supply channel through which the ink is fed to said ink chambers of said ink pump member, said orifices communicating with said ink supply channel and said ink chambers, for guiding the ink from the ink supply channel to the respective ink chambers.

13. An ink jet print head as defined in claim 12, wherein said channel plate of said nozzle member has a plurality of through-holes formed therethrough, for permitting discharge of the ink from said ink chambers toward said nozzles, and a multiplicity of holes formed therethrough over an entirety of the area of a surface thereof except said window and said plurality of through-holes.

14. An ink jet print head as defined in claim 1, wherein said ink pump member comprises a closure plate, a spacer plate and a connecting plate which are laminated on each other such that said spacer plate is interposed between said closure plate and said connecting plate, said spacer plate having a pluraltiy of windows that are closed by and between said closure plate and said connecting member to provide said plurality of ink chambers.

15. An ink jet print head as defined in claim 14, wherein said adjusting member consists of said connecting plate of said ink pump member.

16. An ink jet print head as defined in claim 14, wherein said piezoelectric/electrostrictive elements are formed on said closure plate of said ink pump member, each of said piezoelectric/electrostrictive elements consisting of an upper electrode, a lower electrode, and a piezoelectric/electrostrictive layer interposed between said upper and lower electrodes.

* * * * *